United States Patent [19]

Colle, Jr.

[11] Patent Number: 4,632,034

[45] Date of Patent: Dec. 30, 1986

[54] REDUNDANT DETONATION INITIATORS FOR USE IN WELLS AND METHOD OF USE

[75] Inventor: Edward A. Colle, Jr., Houston, Tex.

[73] Assignee: Halliburton Company, Duncan, Okla.

[21] Appl. No.: 587,340

[22] Filed: Mar. 8, 1984

[51] Int. Cl.[4] ..... F42B 3/00

[52] U.S. Cl. ..... 102/312; 102/313; 102/322; 102/320; 102/275.11; 166/63

[58] Field of Search ..... 102/200, 275.3, 275.11, 102/312, 313, 322, 320; 166/63; 86/1 B

[56] References Cited

U.S. PATENT DOCUMENTS

| | | | |
|---|---|---|---|
| 2,475,875 | 7/1949 | Burrows et al. | 102/275.3 X |
| 2,595,615 | 5/1952 | Sweetman | 102/200 X |
| 2,707,439 | 5/1955 | Hamilton | 102/275.3 |
| 3,174,545 | 3/1965 | Mohaupt | 102/313 X |
| 3,353,485 | 11/1967 | Miller et al. | 102/275.3 X |
| 3,618,522 | 11/1971 | Henderson | 102/275.3 X |
| 3,727,552 | 4/1973 | Zakheim | 102/275.3 X |
| 3,762,267 | 10/1973 | Travor et al. | 102/275.11 |
| 4,208,966 | 6/1980 | Hart | 102/313 X |
| 4,250,960 | 2/1981 | Chammas | 166/63 X |
| 4,429,741 | 2/1984 | Hyland | 89/1 B X |

FOREIGN PATENT DOCUMENTS

| | | | |
|---|---|---|---|
| 2040025 | 8/1980 | United Kingdom | 102/275.3 |

*Primary Examiner*—Peter A. Nelson

*Attorney, Agent, or Firm*—James R. Duzan

[57] ABSTRACT

Methods and apparatus are provided for detonating high explosive devices downhole in a well. A high explosive device includes a detonating cord having a first end and a second end. A first device is provided for initiating a detonation of a detonating cord at its first end and a second device is provided for initiating a detonation of the detonating cord at its second end.

8 Claims, 6 Drawing Figures

FIG. 5
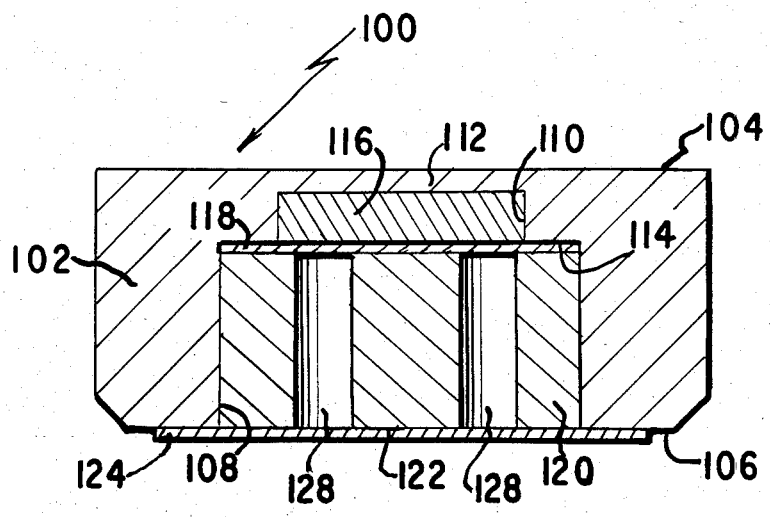
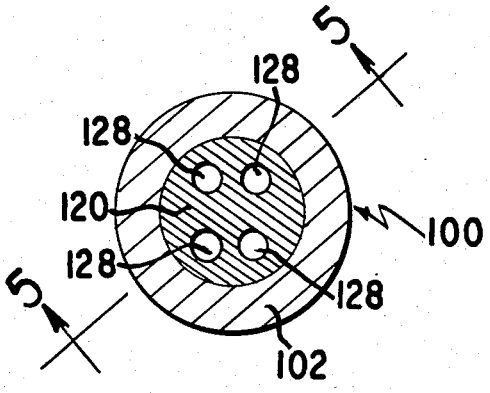
FIG. 4

REDUNDANT DETONATION INITIATORS FOR USE IN WELLS AND METHOD OF USE

BACKGROUND OF THE INVENTION

The present invention relates to apparatus and methods for improving the reliability of high explosive devices utilizing detonation transmitting devices, such as detonating cords, and adapted for use downhole in a well.

High explosive devices are utilized for various purposes in wells, for example, to perforate the well casing. Such devices typically employ a number of high explosive charges joined by a detonating cord for group actuation. Often a succession of detonating cords will be run several hundreds of feet in order to permit several perforating guns to be detonated as a group and at widely spaced locations. Such operations are time consuming and expensive to carry out, and especially so where long or widely spaced intervals are to be perforated. It is, therefore, essential that the explosive devices operate reliably.

An advantageous well completion technique employs perforating guns lowered into the well on a tubing string. When the guns have been positioned adjacent the zones to be perforated, a packer is set to isolate the casing annulus adjacent the zones to be completed, the desired pressure condition in the annulus is established (for example, an underbalanced pressure condition) and then a detonating bar is dropped through the tubing from the surface to impact on a firing head to initiate the detonation of the guns through the detonation of the detonating cord.

The downhole environment presents a number of complicating factors which can interfere with the proper operation of the firing system. For example, in a highly deviated well, the detonating bar can become stuck in the tubing before impacting on the firing head. Also, in very hot wells, the operation of the impact-sensitive initiator can be adversely affected by heat so that, even if the bar does impact on the firing head, no detonation occurs. Even where the initiator operates properly, the detonating cord may fail to detonate its entire length. This can occur due to a break in the cord or a failure of the detonation to transfer from one length of cord to the next. Where it is necessary to run very long lengths of detonating cord, it correspondingly becomes more likely that the cord will not detonate its entire length, in which event it will be necessary to pull the string and attempt to complete the unperforated zones by repeating the entire operation.

SUMMARY OF THE INVENTION

In accordance with one aspect of the present invention, a method is provided of detonating a high explosive device downhole in a well. The high explosive device includes means for transmitting a detonation from a first end thereof to a second end thereof. A first initiator means is positioned to initiate a detonation of the transmitting means at the first end in response to a first stimulus and a second initiator means is positioned to initiate a detonation of the transmitting means at the second end in response to a second stimulus. The method comprises the steps of: applying the first stimulus to the first initiator means; and applying the second stimulus to the second initiator means. Accordingly, if the first stimulus (for example, a bar dropped through tubing from the surface) fails to initiate a detonation of the transmitting means (for example, a detonating cord), the second stimulus is applied (for example, the application of pressure to a pressure operated firing head on the opposite end of the transmitting means). It is, therefore, much less likely that it will be impossible to detonate the transmitting means on a single trip into the well. In addition, if the transmitting means fails to detonate its entire length, it may be detonated at its opposite end.

In accordance with a further aspect of the present invention, a high explosive device adapted for use in a well is provided. The device comprises: means for transmitting a detonation from a first end thereof to a second end thereof; first means for initiating a detonation of the transmitting means at the first end thereof; and second means for initiating a detonation of the transmitting means at the second end thereof.

BRIEF DESCRIPTION OF THE DRAWINGS

The present invention, as well as further objects and features thereof, will be understood more clearly and fully from the following description of certain preferred embodiments, when read with reference to the accompanying drawings, in which:

FIG. 4 is a cross-sectional view taken along the lines 4—4 in FIG. 3 of a primer assembly for use in the device thereof;

FIG. 5 is a cross-sectional view taken along the lines 5—5 in FIG. 4.

DETAILED DESCRIPTION OF CERTAIN PREFERRED EMBODIMENTS

Figure 1:
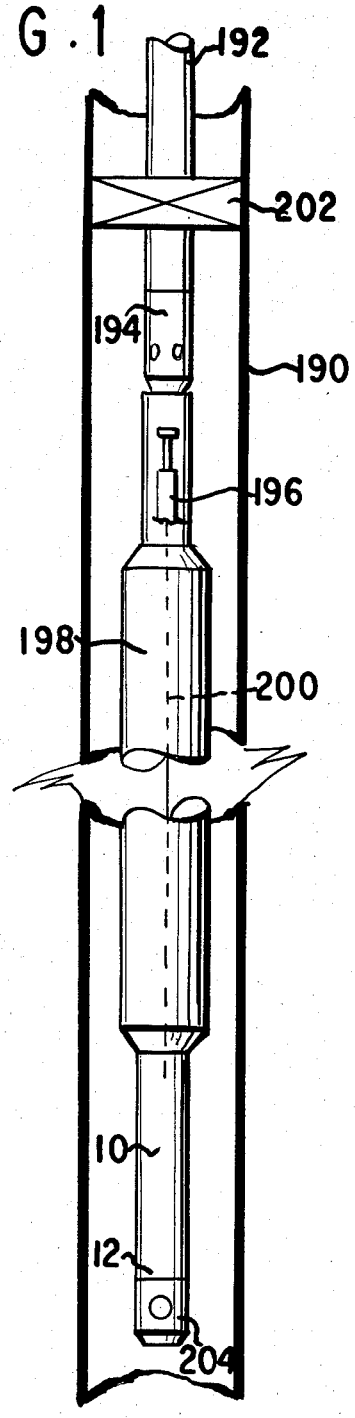
FIG. 1 is a partially cross-sectional view of a cased wellbore wherein a tubing string has been lowered to position perforating guns opposite a portion of the casing to be perforated.

With reference first to FIG. 1, a wellbore in the earth has a casing 190 cemented in place therein. A tubing string 192 has been lowered into the wellbore and suspends an assembly including a perforated nipple 194 at the lower end thereof. Nipple 194 is coupled at its lower end to a standard bar-actuated firing head 196. A string of perforating guns 198 is suspended from the firing head at its lower end and a pressure actuated firing head 10 is coupled to the perforating guns at a lower end thereof to provide a redundant gun firing means. A detonating cord 200 (shown in phantom lines) runs the entire length of guns 198 and is coupled at its upper end to the standard firing head 196 and at its lower end to the pressure actuated firing head 10.

The tubing string 192 carries a retrievable packer 202 above the perforated nipple 190. In FIG. 1, packer 202 has been set to isolate a lower casing annulus wherein the guns 198 are positioned for perforating the casing 190, from an upper casing annulus. Accordingly, a desired pressure condition in the lower casing annulus can now be achieved, for example an underbalanced condition achieved by swabbing well fluids from the tubing 192 to a desired depth to adjust the hydrostatic pressure in the lower casing annulus. In order to perforate the casing, the pressure in the tubing string 192 is elevated to increase the pressure in the lower casing annulus. A perforated bull plug 204 is coupled to the firing head 10 at its lower end 12 in order to pressure the firing head 10. As the pressure applied to the firing head is increased beyond a predetermined level, a combustive reaction is initiated in the firing head 10. Several minutes after this reaction commences, the firing head 10 detonates the detonating cord 200 at its lower end. If the cord 200 detonates its entire length, it is most likely that the perforating charges coupled with the cord 200 will all be fired to produce all of the desired perforations.

If, however, the firing head 10 fails to operate properly, or the detonating cord fails to detonate completely, the firing head 196 provides a second means for initiating the detonation of the detonating cord 200 at its second end. In that event, a detonating bar is dropped down the tubing 192 to impact upon the firing head 196 which is operative to detonate the cord 200 at its upper end. It will be seen, therefore, that by providing two independently actuable initiators, it is much less likely that it will not be possible to detonate the guns 198 on a single trip into the borehole. It will also be seen that, by actuating both initiators, the likelihood that the detonating cord has been detonated its entire length is increased.

Figure 2:
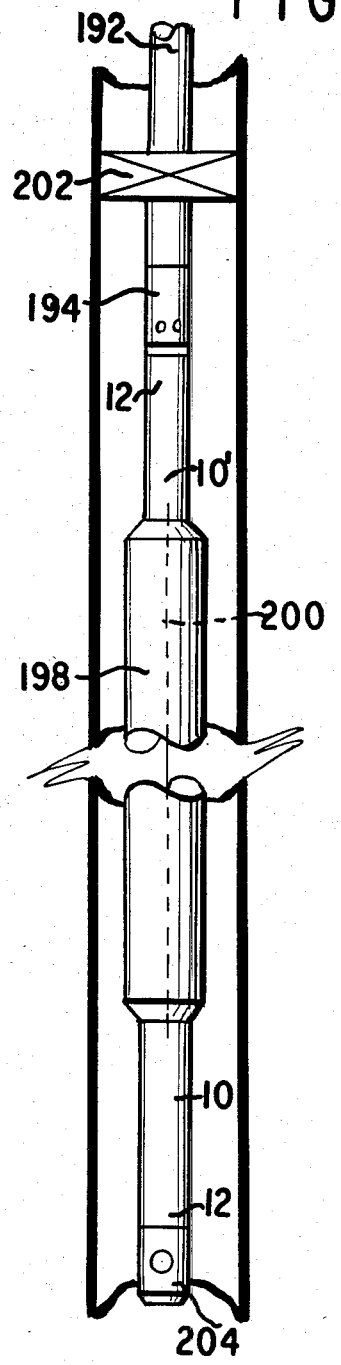
FIG. 2 is a partially cross-sectional view of a wellbore, such as that of FIG. 1, wherein a modified version of the FIG. 1 apparatus is positioned for perforating the well casing at a desired location.

With reference to FIG. 2, the borehole of FIG. 1 is shown having a modified version of the tubing string therein for perforating its casing at a desired location. In place of the firing head 196, a second pressure actuated firing head 10' has been substituted for firing head 196 and provides a means of detonating the cord 200 at its upper end. In use, the pressure in the tubing 192 is increased until the predetermined value is exceeded so that both of the firing heads 10 and 10' initiate their combustive reactions at essentially the same time. Once these reactions have timed out after a period of minutes (permitting the pressure in the tubing string 192 to be reduced, if desired) the firing head 10 initiates a detonation of the detonating cord 200 at its lower end and essentially simultaneously therewith, firing head 10' initiates a detonation of the firing cord 200 at its upper end. It will be seen that the arrangement of FIG. 2 is relatively less time consuming to operate than that of FIG. 1, while providing a more reliable technique than those of the prior art utilizing a single means of detonating a high explosive in a wellbore.

Figure 3:
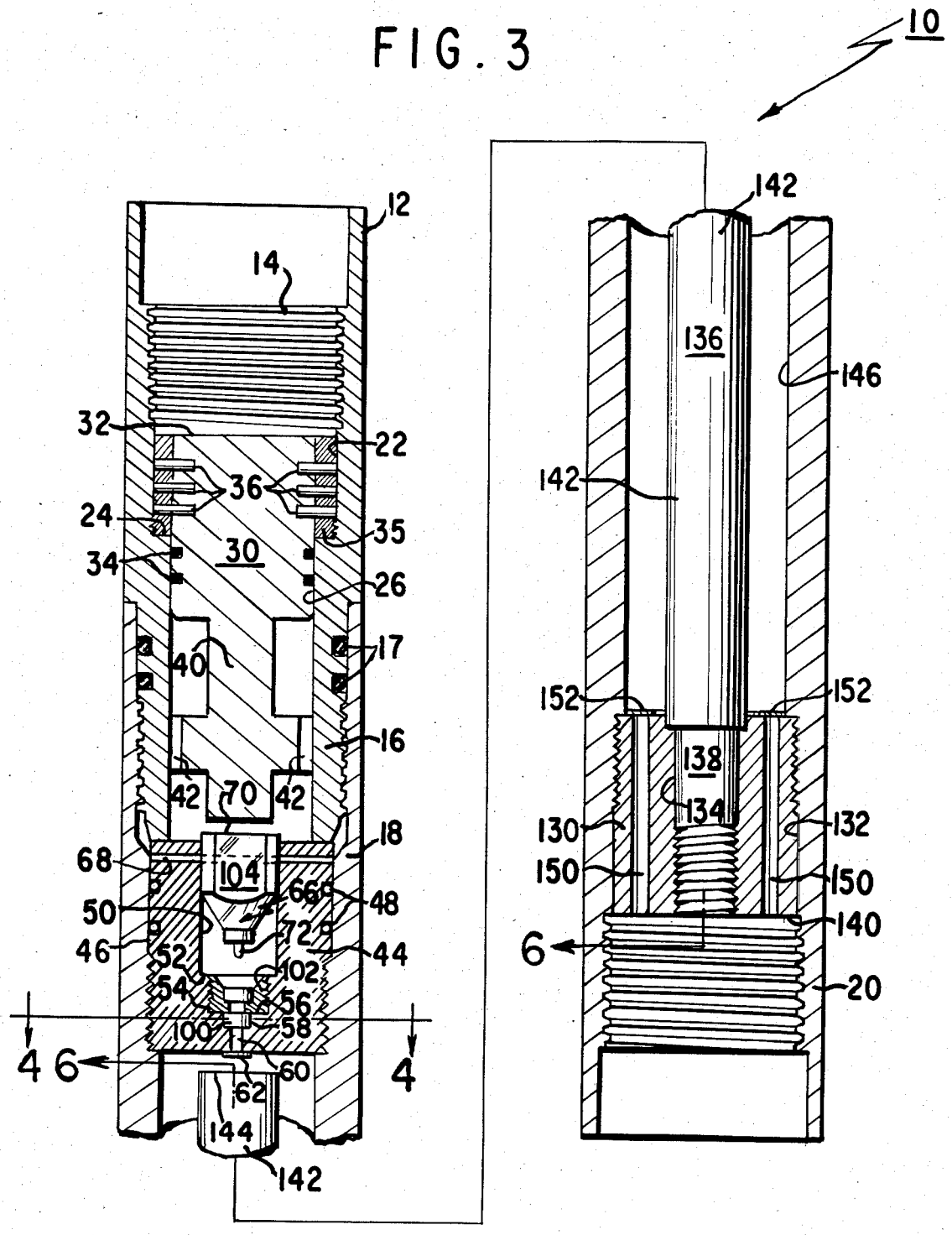
FIG. 3 is a partially cross-sectional view of a pressure actuated detonation initiator incorporated in the embodiments of FIGS. 1 and 2.

The FIGS. 3–6 illustrate the firing heads 10, 10' in greater detail. For convenience hereinafter, the firing heads 10, 10' are referred to jointly as firing head 10. With reference to FIG. 3, the firing head 10 thereof includes an upper sub 12 having an upper set of threads 14 for coupling the firing head 10 to a tubing string for lowering into a well.

Upper sub 12 has a reduced diameter, lower portion 16 forming a pin threadedly coupled to a housing 18 and sealed thereagainst by a pair of O-rings 17. Housing 18 is threaded at a lower portion 20 thereof for coupling the firing head 10 to a perforating gun or other downhole explosive device. Although sub 12 is normally an upper sub, it will be seen that the firing head 10 can be operated so that sub 12 is disposed below housing 18, as in FIG. 1.

Immediately beneath the threaded portion 14, upper sub 12 has a first relatively large diameter counterbore 22 bounded at its lower extremity by an annular shoulder 24. Beginning at an inner edge of shoulder 24 is a downwardly extending second, relatively smaller diameter counterbore 26 extending through a lower extremity of upper sub 12. A piston ram 30 has an upper piston 32 fitting closely against the counterbore 26 of upper sub 12 and having two O-ring seals 34 providing a fluid tight seal between the piston 32 and the counterbore 26. Piston 32 extends upwardly from counterbore 26 and is spaced concentrically from counterbore 22. An annularly shaped piston retainer 34 is fitted within and threadedly coupled to the counterbore 22 and is prevented from moving downwardly within upper sub 12 by the shoulder 24. Retainer 34 has an inner surface dimensioned to fit closely against the outer surface of the piston 32. In the embodiment of FIGS. 3–6 six shear pins 36 couple the piston ram 30 to the piston retainer 34 to restrain the piston ram 30 against movement downwardly with respect to upper sub 12 until such time as a sufficient pressure differential is applied across the piston of piston ram 30 to shear the pins 36. Piston ram 30 also includes a downwardly extending, reduced diameter projection 40 having a plurality of radially extending fins 42 which serve in part to center the projection 40 in the counterbore 26. Fins 42 also limit the downward travel of ram 30, as described more fully below.

Immediately below the upper sub 12 and piston ram 30, a generally cylindrical upper plug 44 is threadedly retained within a counterbore 46 of the housing 18. Upper plug 44 has a pair of O-ring seals 48 forming a fluid tight seal with the housing 18 at the counterbore 46. Upper plug 44 has a first concentric relatively large diameter counterbore 50 extending from an opening in an upper surface of the counterbore 44 downwardly to an inwardly extending shoulder 52. Extending downwardly from an inner extremity of the shoulder 52 is a second relatively smaller diameter concentric counterbore 54 which terminates at a shoulder 56. Extending downwardly from an inner extremity of shoulder 56 is a third counterbore 58 having yet a smaller diameter. Extending from the counterbore 58 through the lower extremity of upper plug 44 is a relatively small concentric cylindrical opening 60. The lower extremity of opening 60 is hermetically sealed by a circular stainless steel closure disk 62 spot welded to the upper plug 44.

A firing pin 66 is held within the counterbore 50 and above the counterbore 54 by a shear pin 68. Firing pin 66 has an upper surface 70 positioned to receive the impact of projection 40 of piston ram 30 in order to force the firing pin 66 downwardly within counterbore 50 of upper plug 44. A lower portion of firing pin 66 is formed as a relatively narrow projection 72 which impacts against a percussion primer assembly 100 when the firing pin 66 is forced downwardly from counterbore 50. Assembly 100 is held within counterbore 58 by a primer retainer 102 which is threaded into counterbore 54. Retainer 102 has a concentric opening therethrough shaped to receive the lower portion of firing pin 66 and guide the projection 72 into engagement with the primer assembly 100. The firing pin 66 has a number of depressions 104 in an outer surface of its upper, relatively large diameter portion to permit air beneath firing pin 66 to flow upwardly past it as firing pin 66 moves downwardly.

With reference to FIGS. 4 and 5, the percussion primer assembly 100 includes a generally cylindrical primer cup 102 having an upper flat surface 104 and a lower flat surface 106. The surface 106 has a concentric, cylindrical bore 108 formed therethrough toward surface 104. A concentric, cylindrical counterbore 100 also is formed in cup 102 from an upper boundary of bore 108 and terminating a short distance from surface 104, thus to form a thin wall or web 112 therebetween. Counterbore 110 forms an annular shoulder 114 at the upper boundary of bore 108. Primer cup 102 may be made, for example, of stainless steel.

Counterbore 110 is filled with a primer mix 116, described in greater detail below. A stainless steel closure disc 118 is positioned against shoulder 114 to retain the primer mix 116 in counterbore 110. Disc 118 is pressed upwardly against shoulder 114 by a cylindrically shaped stainless steel anvil 120 positioned within bore 108. A lower surface 122 of anvil 120 is flush with surface 106. A second stainless steel closure disc 124 is spot welded to surface 106 to support the anvil 120 within cup 102 and to provide a hermetic seal to protect the primer mix 116 against moisture as well as gases produced by other pyrotechnic material in the device 10.

The primer mix 116 is a pyrotechnic mixture of titanium and potassium perchlorate mixed in a weight ratio of 41% titanium to 59% potassium perchlorate. The titanium is provided in powdered form with particles ranging from 1 to 3 microns in diameter and the potassium perchlorate is provided in powdered form with particles less than 10 microns in diameter. After the powders are thoroughly mixed, they are compacted in counterbore 110 perferably with a pressure of 40,000 psi. Thereafter, the disc 118, the anvil 120 and the closure disc 124 are in turn assembled with the cup 102 and primer mix 116. Further details of the primer mix 116 are disclosed in U.S. application Ser. No. 587,344 entitled PRIMER MIX, PERCUSSION PRIMER AND METHOD FOR INITIATING COMBUSTION, filed on even date herewith.

The thickness of the web 112 and the depth of the counterbore 110, together with the compaction of the primer mix 116, are selected to achieve the desired impact sensitivity. That is, as the thickness of web 112 is increased, impact sensitivity of the primer mix 116 in the assembly 100 is decreased, and as the depth of counterbore 110 is increased, so likewise is the impact sensitivity decreased. Moreover, as the density of the primer mix is increased (by increasing the compaction pressure), so also is the impact sensitivity lowered. In the disclosed embodiment, the thickness of the web 112 is nominally 0.011 inch thick and the depth of the counterbore 110 is nominally 0.035 inch deep. Where the primer mix is compacted from 68% to 81% of crystal density in this housing, an impact sensitivity in excess of 4 ft.-lbs. can be achieved and often is.

In use, the projection 72 of firing pin 66 impacts the web 112 to deform it inwardly, thus forcing the primer mix 116 against the anvil 120 to ignite it. Web 112 is made sufficiently thin so that it will be deformed adequately by the impact of the projection to ensure ignition. Upon ignition, the hot gases thus produced shatter the thin closure disc 118. Anvil 120 is provided with four longitudinally extending openings 128 therethrough which then form four jets of hot ignition gas and steel particles from disc 118. These jets of gas then burst through disc 124 to provide a means of igniting a flash sensitive, first fire mix, such as AlA.

With reference again to FIG. 3, a lower plug 130 is threadedly received within a counterbore 132 of the lower portion 20 of housing 18. Lower plug 130 has a central aperture 134 therethrough with a threaded lower portion. An elongated, generally cylindrical delay element assembly 136 is threaded at a reduced diameter lower portion 138 thereof. Portion 138 of assembly 136 is threaded into the aperture 134 so that a lower surface of portion 138 is flush with a lower surface 140 of plug 130. An upper relatively larger diameter portion 142 of assembly 136 extends upwardly from plug 130. An upper surface 144 of portion 142 is disposed adjacent aperture 60 of upper plug 44. Housing 18 has a further counterbore 146 spaced from upper portion 142 of assembly 136 to define a plenum chamber therebetween.

In operation, the jet of gases and hot particles emitted through aperture 60 by primer assembly 100 in response to the impact of projection 72 of firing pin 66 acts as a signal to initiate a combustive reaction within assembly 136. This combustive reaction proceeds for a period of time sufficient to permit an operator at the wellhead, if so desired, to reduce the pressure in the well to a lower value desired at the time that the perforating guns are detonated by the firing head 10. At the end of this time delay, a detonation initiator adjacent the lower end of portion 138 detonates a detonating cord (not shown) coupled to the lower end of portion 138 in order to detonate the guns. As the combustive reaction proceed within assembly 136, combustion gas exits from assembly 136 and fills the plenum chamber.

Lower plug 130 is provided with a plurality of vent apertures 150 therethrough and sealed at their upper ends by closure discs 152. As the combustion gases accumulate within the plenum chamber, they build up a slight pressure differential across the closure discs 152, causing them to rupture and permit the gases to pass downwardly through the apertures 150 so that the gases vent into the gun carriers coupled with the lower portion 20 of housing 18. Since the interior of the firing head 10 below the piston 32 of the piston ram 30 is sealed against fluid pressure and the gun carrier likewise is sealed against fluid pressure, the pressure within the plenum chamber will remain essentially at one atmosphere. In addition, the venting of the combustion gases dissipates heat from the assembly 136. Accordingly, the principal factor in determining the length of the delay provided by the delay element assembly 136 is the downhole ambient temperature.

Figure 6:
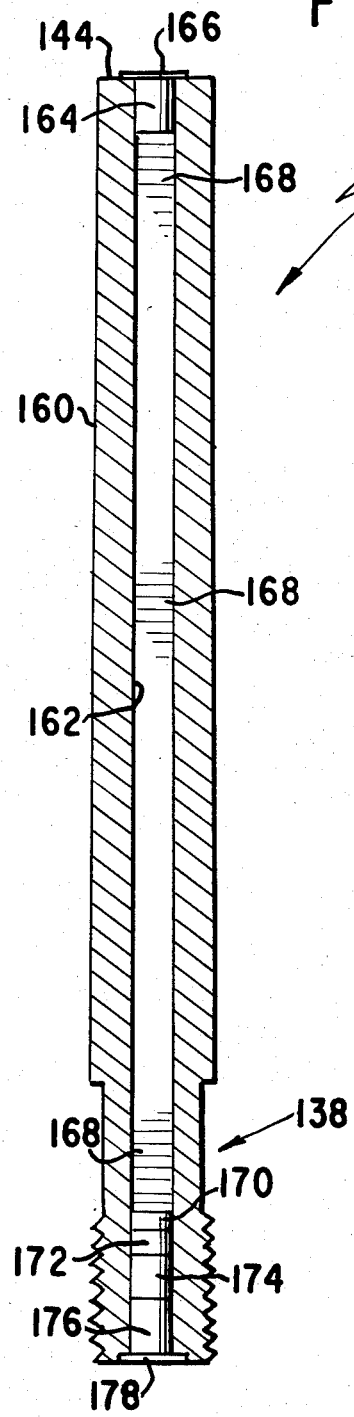
FIG. 6 is a partially cross-sectional view taken along the lines 6—6 in FIG. 3.

With reference to FIG. 6, delay element assembly 136 includes a generally cylindrical housing 160 having a central cylindrical aperture 162. A cylindrical pellet 164 of AlA first fire mix is positioned within aperture 162 so that an upper surface of pellet 164 is flush with the surface 144 of assembly 136 and extends downwardly a short distance therefrom. Aperture 162 is closed at surface 144 by an adhesive high temperature closure disc 166. Upon the ignition of primer assembly 100, the jet of hot gases and particles emitted through aperture 60 breaks through the closure disc 166 and ignites the AlA pellet 164.

A succession of tungston delay composition discs 168 are positioned within aperture 162 to extend from pellet 164 downwardly to a point within aperture 162 approximately half way through the extent of aperture 162 through lower portion 138. In one embodiment, 55 tungston composition discs (mil-T-23132) were utilized, each disc having 500 milligrams of composition compressed at 30,000 psi and forming a column approximately 10 inches high.

Positioned within the aperture 162 immediately below the lowermost tungston disc 168 is a second pellet of AlA 170. Immediately below the pellet 170 is a pellet of a titanium/potassium perchlorate flash charge 172. Immediately below the pellet 172 is a detonator having an upper booster 174 of lead azide (RD-1333) and a lower high explosive output charge 176 which may be either PYX or HNS-II. Aperture 162 is closed at its lower end by a closure disc 178 spot welded to the housing 160. When the last tungston delay element 168 has burned through, it ignites the AlA charge 170 which in turn ignites the charge 172 which serves to provide a deflagrating output to the booster 174 which in turn detonates the high explosive output charge 176. This detonation is transferred to the detonating cord of the perforating guns to cause them to fire, and may thus be regarded as an explosive actuation signal.

The firing head 196 preferably includes a percussion type primer including primer mix 116, described above. Upon impact, the primer detonates a primary high explosive, such as lead azide which in turn detonates a secondary high explosive, such as PYX or HNS-II; the output from the secondary high explosive serves to initiate the detonation of the detonating cord at the respective end thereof by detonating an appropriate booster thereat. Firing head 196 also preferably includes an annular space extending circumferentially about its firing pin and downwardly therefrom, so that particles and debris settling out from well fluids can collect in the annular space below the firing pin without interfering with its operation.

Where a succession of detonating cords are to be detonated in sequence, for example, to fire multiple guns, boosters typically are utilized to couple the detonation of one cord to the next. Preferably, non-directional boosters including a single secondary high explosive which acts both as an acceptor and donor are employed. The high explosive can, for example, be PYX compacted to a density of 1.455 gm/cc in a cup of guilding metal, stainless steel or aluminum. An open end, of the cup is then crimped over the end of the detonating cord.

It will be appreciated that numerous different combinations of detonation initiators may be utilized in the present invention. For example, instead of bar actuated or pressure actuated initiators, one or both of the initiators may be electrically actuated initiators.

The terms and expressions which have been employed are used as terms of description and not of limitation, and there is no intention in the use of such terms and expressions of excluding any equivalents of the features shown and described, or portions thereof, it being recognized that various modifications are possible within the scope of the invention claimed.

I claim:

1. A method of firing a perforating gun having perforating charges therein, said perforating gun having perforating charges therein and being suspended from a tubing string in a well bore extending from the surface of the earth, the method comprising the steps of:

providing a weight actuated firing device on one end of the perforating gun;

providing a pressure actuated firing device on the other end of the perforating gun; and dropping a weight through said tubing string to impact the weight actuated firing device to actuate the firing device to cause the actuation of the perforating charges in said perforating gun.

2. The method of claim 1 further comprising the step of:

supplying fluid pressure to the pressure actuated firing device to actuate the pressure actuated firing device.

3. The method of claim 2 further comprising the step of:

providing a packer in said tubing string above the weight actuated firing device; and providing a perforated nipple below the packer and above the weight actuated firing device.

4. The method of claim 3 further comprising the steps of:

setting the packer before actuating the pressure actuated firing device.

5. The method of claim 1 further comprising the steps of:

providing a packer in said tubing string above the weight actuated firing device; and providing a perforated nipple below the packer and above the weight actuated firing device.

6. The method of claim 5 further comprising the step of:

setting the packer before actuating the weight actuated firing device.

7. A well perforating device having perforating charges therein and suspended from tubing or the like in a borehole filled with fluid, said device comprising:

means for transmitting the detonation of the perforating charges from one end to another of said well perforating device;

weight actuated initiator means for initiating the detonation of the means for transmitting the detonation of the perforating charges at one end thereof, the weight actuated initiator means being actuated by a weight dropped through the tubing; and pressure actuated initiator means for initiating the detonation of the means for transmitting the detonation of the perforating charges at the other end thereof, the pressure actuated initiator means being actuated by increasing the pressure of said fluid in at least a portion of said borehole.

8. A well perforating device having perforating charges therein and suspended from tubing or the like in a borehole filled with fluid, said device comprising:

means for transmitting the detonation of the perforating charges from one end to another end of said well perforating device;

first pressure actuated initiator means for initiating the detonation of the means for transmitting the detonation of the perforating charges at one end thereof, the pressure actuated initiator means being actuated by increasing the pressure of said fluid in at least a portion of said borehole; and second pressure actuated initiator means for initiating the detonation of the means for transmitting the detonation of the perforating charges at another end thereof, the pressure actuated initiator means being actuated by increasing the pressure of said fluid in at least a portion of said borehole.

* * * * *